US007403197B2

(12) United States Patent
Eiden et al.

(10) Patent No.: US 7,403,197 B2
(45) Date of Patent: Jul. 22, 2008

(54) MEDALLION DISPLAY WITH REPETITIVE MODE

(75) Inventors: Niko Eiden, Helsinki (FI); Bart Delmulle, Espoo (FI); Riitta Nieminen-Sundell, Helsinki (FI); Jarkko Kuntanen, Espoo (FI)

(73) Assignee: Nokia Corporation, Espoo (FI)

( * ) Notice: Subject to any disclaimer, the term of this patent is extended or adjusted under 35 U.S.C. 154(b) by 937 days.

(21) Appl. No.: 10/618,074

(22) Filed: Jul. 10, 2003

(65) Prior Publication Data

US 2005/0007332 A1 Jan. 13, 2005

(51) Int. Cl.
*G09G 5/00* (2006.01)

(52) U.S. Cl. ..... 345/211; 345/102

(58) Field of Classification Search ..... 345/156, 345/102, 96, 159–176, 204, 77, 87–100, 345/101–107; 340/309.16, 815.4; 40/800, 40/219; 200/51 R; 362/106
See application file for complete search history.

(56) References Cited

U.S. PATENT DOCUMENTS 4,222,189 A * 9/1980 Kamei ..... 40/800
5,147,129 A * 9/1992 Ku ..... 362/106
5,217,286 A * 6/1993 Ming-ho ..... 362/612
5,736,973 A 4/1998 Godfrey et al. ..... 345/102
5,933,130 A 8/1999 Wagner ..... 345/147
6,006,335 A * 12/1999 Choi et al. ..... 713/310
6,265,984 B1 * 7/2001 Molinaroli ..... 340/815.4
6,903,284 B2 * 6/2005 Dunfield et al. ..... 200/51 R
7,154,380 B1 * 12/2006 Tarrab, Jr. ..... 340/309.16
2003/0001813 A1 * 1/2003 Sekiguchi ..... 345/96
2007/0146354 A1 * 6/2007 Kubota et al. ..... 345/204

* cited by examiner

*Primary Examiner*—Nitin Patel

(57) ABSTRACT

A medallion to be worn by a user, the medallion being functional in more than one mode, the medallion including an image display, a power source responsive to a fade-in signal and a fade-out signal, mode selection means for providing a repetitive mode selection signal if the user selects a repetitive mode, and a timing control means that is responsive to the repetitive mode selection signal from the mode selection means, the timing control means being for automatically and repeatedly providing the fade-in signal and the fade-out signal to the power source.

33 Claims, 2 Drawing Sheets

MEDALLION DISPLAY WITH REPETITIVE MODE

TECHNICAL FIELD OF THE INVENTION

The invention relates to a personal accessory having electronic functionality, and in particular having a battery-powered visual display.

BACKGROUND ART

It is well known to wear a medallion attached to a necklace, and it is also known for the medallion to electronically show an image. Typically, a backlight in the medallion is turned on by pressing a button, and then the device stays on for a certain limited period of time.

Such a medallion must typically be small in size, in order to comfortably and fashionably attach to a necklace. However, this small size limits battery capacity, which in turn limits the time during which the display can remain backlit. A typical battery will allow the medallion to be fully backlit for only ninety (90) minutes, or for three (3) hours with half brightness.

When the backlight is off, the image may still be somewhat visible when there is sufficient ambient light in the environment, because a display can operate reflectively without backlighting. However, the visibility is poor for color images in reflective mode, and it is then difficult for a person to recognize the reflective image in an indoor lighting environment. Likewise, no matter how good the display is in reflective mode, there will always be environments—such as a bar—where there is not enough ambient light to see the image reflected from the medallion's display. Therefore, the limited reflective properties of a transflective Liquid Crystal (LCD) display do not eliminate the need to extend the operating life beyond three hours.

It is known to slightly vary the brightness of an LCD display in order to decrease prolonged eye strain. The idea is that when the LCD image has a different brightness, then different eye muscles will be used for viewing, and thus varying the brightness slightly will allow previously used eye muscles to rest. See Wagner (U.S. Pat. No. 5,933,130). However, for a person wearing or observing a medallion, there is no problem of prolonged eye strain. Moreover, the slight variations of brightness in Wagner will not have a significant impact on energy consumption or battery life.

It is known to reduce the power input into an image display in order to prolong battery life. See Godfrey (U.S. Pat. No. 5,736,973). However, such known transflective LCD technology requires that the power input be changed based upon the amount of enivronmental lighting, rather than based upon other factors, and moreover requires that the environmental lighting be monitored by a sensor or by the user.

DISCLOSURE OF THE INVENTION

The present invention is a medallion to be worn by a user, the medallion being functional in more than one mode, including a repetitive mode, in which the backlight fades in and out. Instead of being fully on or fully off, this medallion can alternatively function in this repetitive mode, which allows the battery to supply power over a much longer total time than in the fully on mode.

As mentioned, a typical battery will support half-brightness for only three (3) hours. However, using the present medallion, the battery is guaranteed to last at least fifteen (15) hours, including as much as five (5) hours backlit at partial brightness. This is a very significant increase as compared to the prior art.

This medallion includes an image display, responsive to input power, for providing at least one illuminated image by means of the image display. The medallion also includes a power source, responsive to a fade-in signal and a fade-out signal, for providing the input power to the image display. The medallion further includes mode selection means, responsive to a selection from the user who selects a mode of operation, for providing a repetitive mode selection signal if the user selects a repetitive mode. Additionally, the medallion comprises timing control means, responsive to the repetitive mode selection signal from the mode selection means, for automatically providing the fade-in signal indicative of increased power, and the fade-out signal indicative of decreased power, repeatedly.

The medallion will typically include at least three different modes, and a user can select which mode is desired. These modes include the repetitive mode in which the illuminated image fades in and later fades out if the environment is dark. The modes also include an off mode in which the image is not visible if the medallion is in a dark environment. And, the modes additionally include a fully on mode in which the at least one illuminated image is fully visible without fading, at least for a certain limited time, after which the medallion automatically changes to one of the other modes.

The timing control means of the present invention operates the medallion with less than full power at substantially all times during the repetitive mode, while varying the power during the repetitive mode so that the image has an intensity which appears constant to a human eye over a period of less than five seconds, or over longer periods such as ten seconds, twenty seconds, or thirty seconds. In this sense, the medallion is similar to an ordinary sunrise in the morning; the sunrise occurs so gradually that a human being cannot notice the motion of the Sun over short periods of time. The timing control means of the present invention will advantageously include programming, software or instructions which are embodied in media that is encoded with a data structure, for controlling the medallion's repetitive mode.

The power source of the present invention will typically include a battery, and some sort of switching device for regulating the power flow from the battery to the image display. The switching device can be a mechanical switch or relay having a duty cycle, or it can be a transistor device in a solid state with a duty cycle; however, using a variable resistor or potentiometer instead, as in Wagner, would not be advisable due to the energy that would thereby be wasted.

The medallion advantageously includes a memory for receiving the image via an infrared signal to the medallion, and the memory then provides the image to the image display. The medallion will preferably have an infrared communication interface, for outputting image data from the medallion or inputting image data to the medallion.

The image display should include a transflective liquid crystal display with a backlight, and the reflective properties of such a display allow the user to take full advantage of environmental light, and thus further conserve battery energy. The medallion's power source is for powering the image display with less than or equal to half of the full power at substantially all times during the repetitive mode, so the image will fade in and out but will not attain a brightness substantially more than the full brightness in the fully on mode.

Each repetition during the repetitive mode includes an off stage, a fade-in stage, an on stage, and a fade-out stage. So, the image will not necessarily be always fading in or out, and instead can have an intensity that is constant between fading in and fading out. The duration of the on stage will typically have a constant ratio to the off duration, and this constant ratio should ideally be about one half.

The repetitions during the repetitive mode need not have a constant duration, although the difference between the durations of any two repetitions should be small, e.g. the difference is less than one-tenth of the first duration, but otherwise has a random element. Thus, the durations of the repetitions will seem to the user to have an unpredictable or variable element.

The present invention also includes a method of operating the medallion including the steps of selecting a mode of operation, providing a repetitive mode selection signal if the repetitive mode is selected, and automatically providing a fade-in signal indicative of increased power, and a fade-out signal indicative of decreased power, repetitively. The method further includes inputting power to the image display, And providing at least one illuminated image by means of the image display, in response to the inputted power.

BEST MODE FOR CARRYING OUT THE INVENTION

Figure 1:
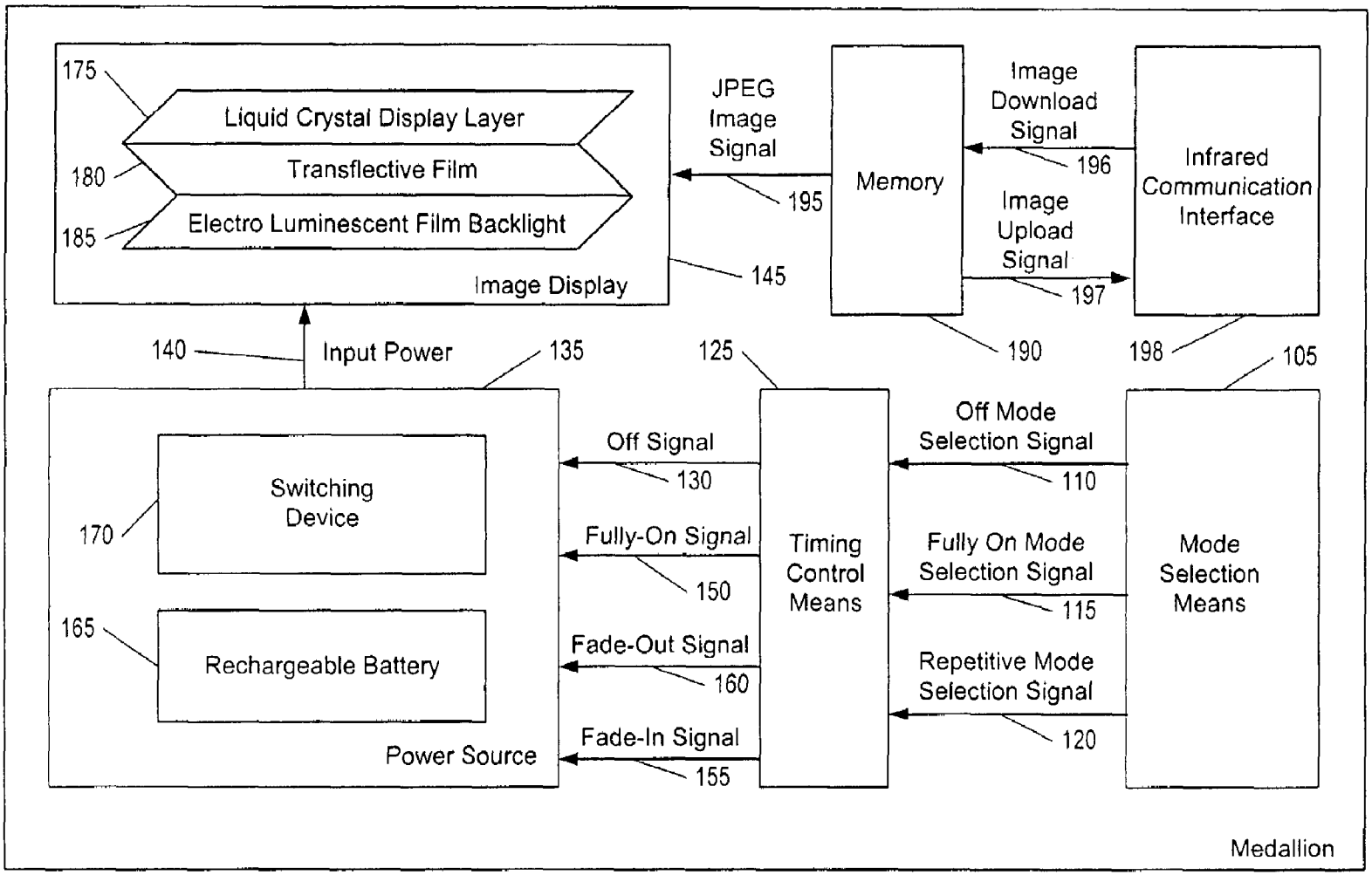
FIG. 1 is a block diagram of the medallion according to the present invention.

According to a best mode embodiment of the present invention in its repetitive mode, the backlight of the medallion follows a light pattern similar to the light pattern of nature, in the sense that light intensity slowly fades out, and later slowly fades in, repeating over and over although not necessarily in exactly the same way. This type of repetitive structure is not only pleasing to the eye, but is also a very practical way of increasing battery life between recharging, so that the visual image from the medallion will be available for a much longer period of time, albeit with intermittent gaps.

Just like the Sun, the backlight will gradually start to turn on, stay on for a while, and then begin to darken again. Each repetition includes an off stage having duration A+r, a fade-in stage having during B+r, an on stage having duration C+r, and a fade-out stage having duration D+r. The quantities A-D are pre-set values for duration. They are chosen so that the battery will last for a required fifteen (15) hours.

The random time element "r" has a small effect relative to the main quantities A-D. This random element enhances the similarity between the present medallion and natural illumination, inasmuch as the length of natural daylight is always changing. In effect, the medallion in its repetitive mode will lead a life of its own, and will not be visible all the time, especially in dark environments.

The main quantities A-D and "r" are flexible, and the primary requirement for these values is that the ratio of on time to off time must be about one to two. So, for example, the backlight would be on for one minute, then off for two minutes during several repetitions, and then the backlight would be on for two minutes and off for four minutes during several more repetitions. The random element "r" is selected so that the ratio of one to two is maintained.

The present medallion is designed so that the change of brightness of the medallion's image display occurs slowly as seen by the human eye. This change occurs slowly enough so that an inelegant or abrupt flashing effect can be avoided.

In this best embodiment, the medallion's image display will present images that are in Joint Photographic Experts Group (JPEG) format, and therefore the image can be a photograph or a document or some other object that is converted to JPEG format. The resolution of the display is 96×96 pixels. Color pictures are supported, but black and white pictures can be shown as well if the original image is black and white.

The medallion need not have an light sensor. However, such a sensor is possible in order to, for example, change the medallion to off mode when the ambient light is bright enough to adequately display the image without significant power from the battery. If the medallion is in off mode, then the battery need not be recharged daily. Recharging typically takes about three (3) hours. The battery cannot be replaced or removed by the user.

Although the medallion's display will not exceed half brightness in the repetitive mode, the user is always able to turn the backlight fully on or fully off. This can be done by flipping a switch or pressing a button to change the mode.

New images can be easily sent to or from the medallion by an Infrared Data Association (IrDA) transmission from, for example, a telephone, computer, or another medallion. Likewise, images can be deleted from the medallion's memory, for example when the user presses two button simultaneously and confirms the deletion.

Further details of this best mode embodiment of the present invention can be seen in the figures. Referring now to FIG. 1, the medallion 100 incudes a mode selection means 105 which allows the user to select a desired mode of operation, for example by pressing a button or sliding a switch. Depending upon the user's selection, the mode selection means 105 will send a selection signal that may be an Off Mode Selection Signal 110, or a Fully On Mode Selection Signal 115, or a Repetitive Mode Selection Signal 120. This signal is sent to the Timing Control Means 125.

In the case of Off Mode, the Timing Control Means 125 would simply send an Off Signal 130 to the Power Source 135 in order to shut off the Input Power 140 to the Image Display 145. However, in the alternative case of Fully-On Mode, the Timing Control Means 125 would send a Fully-On Signal 150 to the Power Source 135 in order to supply full power to the Image Display 145 for an indefinite time, or for a limited time until the Timing Control Means automatically sends the Off Signal 130.

The third alternative is the case of Repetitive Mode. In this mode, the Timing Control Means 125 alternately sends a Fade-In Signal 155 and a Fade-Out Signal 160 to the Power Source 135. As mentioned previously, this will cause the image displayed by the Image Display 145 to gradually reach a certain partial brightness, remain at this partial brightness, and then gradually fade. This mode extends the battery lifetime beyond what it would be at continuous half-brightness, so that a user will be able to use the medallion's image display for at least fifteen (15) hours without needing to recharge.

The Power Source 135 includes a rechargeable battery 165 and a Switching Device 170. The Switching Device 170 is preferably a transistor having a controllable duty cycle, so that it will operate similarly to a variable resistor but without wasting energy. The duty cycle will be controlled by the signals from the Timing Control Means 125, so as to adjust the brightness of the Image Display 145.

The Image Display 145 comprises a Liquid Crystal Display Layer 175, a Transflective Film 180, and an Electro Luminescent Film Backlight 185 which have well known structures and functions. The image displayed at the CD layer is supplied from a memory 190 via a JPEG Image Signal 195. Such images can be downloaded to the medallion or uploaded from the medallion by an Image Download Signal 196 or an Image Upload Signal 197 respectively, for example via an Infrared Communication Interface 198 or other suitable communication technique, in a manner that is well known.

Figure 2:
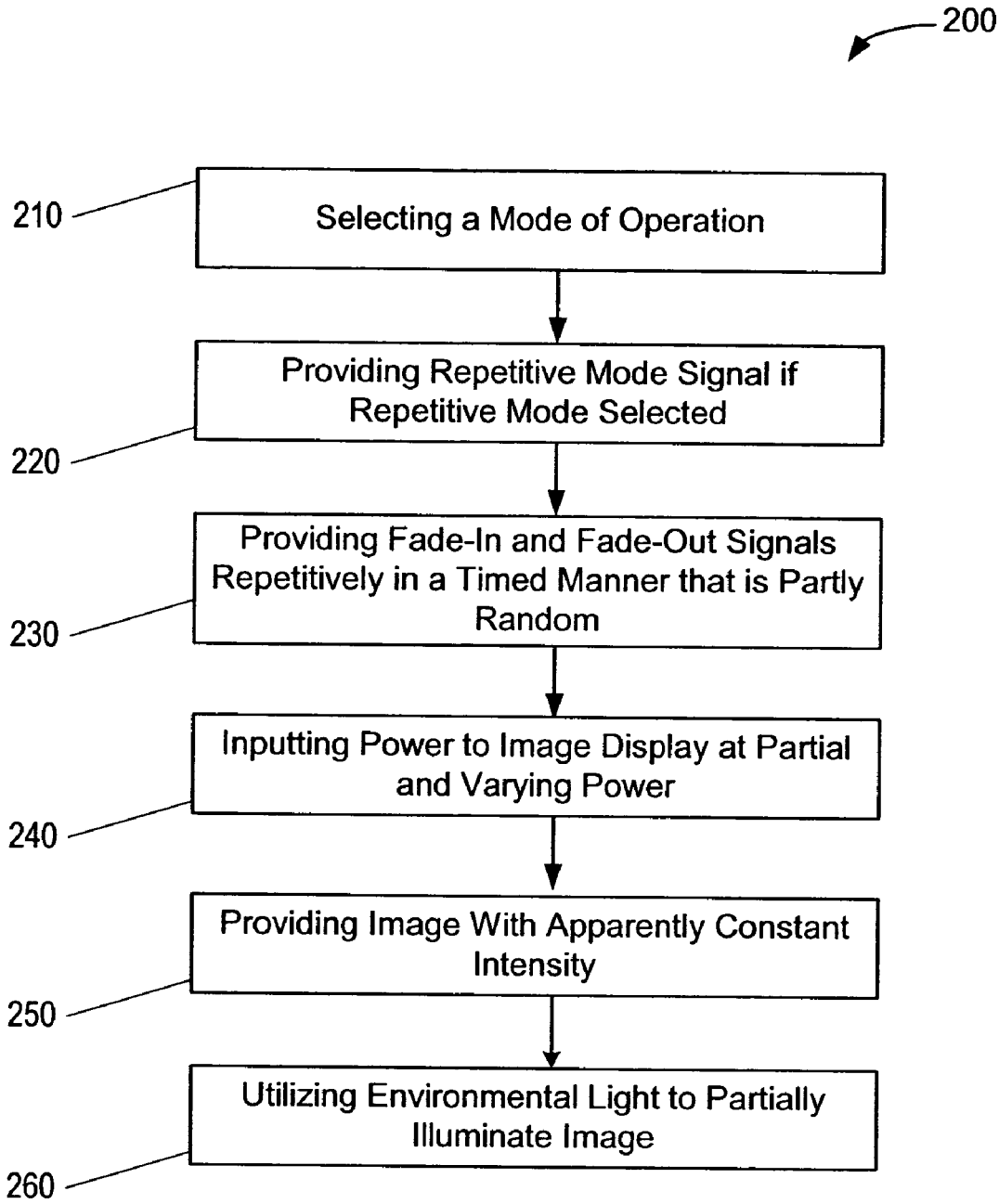
FIG. 2 is a flow chart describing the method of the present invention.

Turning now to the flow chart shown in FIG. 2, this flow chart will help to more particularly point out the features already discussed herein. The method 200 begins by selecting 210 a mode of operation. The next step is providing 220 a repetitive mode signal if the repetitive mode was selected, in order to indicate that selection has occurred. Subsequently, the method requires providing 230 timed fade-in and fade-out signals repetitively, thus triggering the next step, which is inputting 240 power into the image display at partial power. Typically, this power will be input at less than or substantially equal to half of full power. Once the power is inputted, the method requires providing 250 an image with apparently constant intensity, meaning that the image will be fading in and out over an extended period of time but will appear to the human eye to be constant over short periods of time. Finally the method 200 requires utilizing 260 environmental light to partially illuminate the image, thus reducing the power required from the battery.

It is to be understood that all of the present figures, and the accompanying narrative discussions of the best mode embodiments, do not purport to be completely rigorous treatments of the medallion and method under consideration. A person skilled in the art will understand that the steps and signals of the present application represent general cause-and-effect relationships that do not exclude intermediate interactions of various types, and will further understand that the various structures, devices, and means described in this application can be implemented by a variety of different combinations of hardware and software which need not be further detailed herein.

What is claimed is:

1. An apparatus comprising;

an image display, responsive to input power, the image display being configured to provide at least one illuminated image by means of said image display;

a power source, responsive to fade-in-signal and a fade-out signal, the power source being configured to provide the input power to the image display;

mode selector, responsive to a selection that selects a mode of operation the mode selector being configured to provide a repetitive mode selection signal if a repetitive mode is selected; and timing controller, responsive to the repetitive mode selection signal from the mode selector, the timing controller being configured to automatically provide the fade-in signal indicative of increased power and the fade-out signal indicative of decreased power, repeatedly, wherein said apparatus is functional in more than one mode and wherein the apparatus is a medallion configured to worn by a human being.

2. The apparatus of claim 1, wherein the more than one mode includes the repetitive mode in which the at least one illuminated image fade in and later fades out if the environment is dark and an off mode in which the image is not visible if the apparatus is in a dark environment and a fully on mode in which the at least one illuminated image is fully visible without fading.

3. An apparatus comprising:

an image display responsive to input power, the image display being configured to provide at least one illuminated image by means of said image display;

a power source, responsive to a fade-in signal and a fade-out signal, the power source being configured to provide a repetitive mode selection signal if a repetitive mode is selected and timing controller responsive to the repetitive mode selection signal from the mode selector, the timing controller being configured to automatically provide the fade-in-signal indicative of increased power, and the fade-out signal indicative of decreased power, repeatedly, wherein said apparatus is functional in more than one mode, and wherein the more than one mode includes the repetitive mode in which the at least one illuminated image fades in and later fades out if the environment is dark and on off mode in which the image is not visible if the apparatus is in a dark environment and a fully on mode in which the image is not visable if the apparatus is in a dark environment and a fully on mode in which the at least one illuminated image is fully visible without fading.

4. The apparatus of claim 3, wherein the timing controller is also configured to operate the apparatus with less than full power at substantially all times during the repetitive mode, and configured to vary the power during the repetitive mode so that the at least one illuminated image has an intensity that appears constant to a human eye over a period of less than five seconds.

5. The apparatus of claim 4, wherein the power source is configured to power the image display with less than or equal to half of the full power at substantially all times during the repetitive mode.

6. The apparatus of claim 4, wherein the timing controller comprises software, embodied in a machine readable media that is encoded with a data structure for operating the timing controller.

7. The apparatus of claim 3, wherein the power source comprises a battery, and also comprises a switching device for regulating the power flow from the battery, and wherein the apparatus is a medallion configured to be worn by a human being.

8. The apparatus of claim 7 wherein the switching device comprises a duty cycle device configured to create a duty cycle which is alterable in order to alter the power flow.

9. The apparatus of claim 7, wherein the switching device comprises a transistor having a duty cycle that changes in response to the fade-in signal and the fade-out signal.

10. The apparatus of claim 3, further comprising a memory configured to receive the at least one image via an infrared signal to the apparatus, and configured to provide the at least one illuminated image to the image display, wherein the image display includes a transflective liquid crystal display with a backlight.

11. The apparatus of claim 10, further comprising a communication interface configured to output image data from the apparatus or input image data to the apparatus.

12. The apparatus of claim 3, wherein each repetition during the repetitive mode includes an off stage, a fade-in stage, an on stage, and a fade-out stage.

13. The apparatus of claim 12, wherein the on stage has an on duration, and an off stage has an off duration, and the on duration has a ratio to the off duration that is substantially equal to a constant.

14. The apparatus of claim 13, wherein the constant ratio is less than or substantially equal to half.

15. The apparatus of claim 12, wherein any two of the repetitions respectively have a first duration and a second duration that differ by a difference that is less than one-tenth of the first duration.

16. The apparatus of claim 15, wherein the difference has a random element.

17. The apparatus of claim 12, wherein each of the stages begins at a time that is selected by the timing controller with a degree of randomness.

18. The apparatus of claim 3, wherein the power source comprises a battery that is rechargeable while the battery is still located within the apparatus.

19. The apparatus of claim 3, wherein the image display comprises a liquid crystal display and a transflective film configured to at least partially reflect environmental light and at least partially light up the at least one image in the presence of environmental light.

20. A method of operation of an apparatus, comprising:

selecting a mode of operation, providing a repetition mode selection signal if the repetitive mode is selected, providing a fade-in signal indicative of increased power, and a fade-out signal indicative of decreased power, repetitively, inputting power to an image display, and providing at least one illuminated image in response to the power, wherein the more than one mode includes the repetitive mode in which the at least one illuminated image fades in and later fades out if the environment is dark and on off mode in which the image is not visible if the apparatus is in a dark environment and a fully on mode in which the image is not visible if the apparatus is in a dark environment and a fully on mode in which the at least one illuminated image is fully visible without fading.

21. The method of claim 20, wherein the apparatus operates with less than full power at substantially all times during the repetitive mode, and wherein the power-up signal and the power-down signal slowly vary the power during the repetitive mode so that the at least one illuminated image has an intensity that appears constant to a human eye over a period of less than five seconds.

22. The method of claim 20, further comprising the step of utilizing environmental light to at least partially illuminate the image, by equipping the apparatus with a liquid crystal display that is transflective.

23. The method of claim 19, wherein the step of providing the fade-in signal and the fade-out signal is performed at times that are selected with a degree of randomness.

24. The method of claim 20, wherein the apparatus is a medallion functional in more than one mode.

25. Software, embodied in a machine readable media that is encoded with a data structure for operating the apparatus of claim 20.

26. An apparatus, comprising selecting a mode of operation, providing a repetitive mode selection signal if the repetitive mode is selected, providing a fade-in signal indicative of increased power, and a fade-out signal indicative of decreased power, repetitively, inputting power to an image display, and providing at least one illuminated image in response to the power, wherein the more than one mode includes the repetitive mode in which the at least one illuminated image fades in and later fades out if the environment is dark and on off mode in which the image is not visible if the apparatus is in a dark environment and a fully on mode in which the image is not visible if the apparatus is in a dark environment and a fully on mode in which the at least one illuminated image is fully visible without fading.

27. The apparatus of claim 26, wherein the apparatus operates with less than full power at substantially all times during the repetitive mode, and wherein the power-up signal and the power-down signal slowly vary the power during the repetitive mode so that the at least one illuminated image has an intensity that appears constant to a human eye over a period of less than five seconds.

28. The apparatus of claim 26, further comprising means for utilizing environment light to at least partially illuminate the image by equipping the apparatus with a liquid crystal display that is reflective.

29. The apparatus of claim 26, wherein the fade-in signal and the fade-out signal are provided at times that are selected with a degree of randomness.

30. The apparatus of claim 26, wherein the apparatus is a medallion functional in more than one mode.

31. An apparatus comprising:

a button or switch configured to select a mode of operation, a mode selector configured to provide a repetitive mode selection signal if the repetitive mode is selected, a timing controller configured to provide a fade -in-signal indicative of increased power and fade-out signal indicative of decreased power, repetitively, a power source configured to input power to an image display and an image display configured to provide at least one illuminated image in response to the power, wherein the more than one mode includes the repetitive mode in which the at least one illuminated image fades in and later fades out if the environment is dark and on off mode in which the image is not visible if the apparatus is in a dark environment and a fully on mode in which the image is not visible if the apparatus is in a dark environment and a fully on mode in which the at least one illuminated image is fully visible without fading.

32. The apparatus of claim 31, wherein the apparatus operates with less than full power at substantially all times during the repetitive mode, and wherein the power-up signal and the power-down signal slowly vary the power during the repetitive mode so that the at least one illuminated image has an intensity that appears constant to a human eye over a period of less than five seconds.

33. The apparatus of claim 31, wherein the fade-in signal and the fade-out signal are provided at times that are selected with a degree of randomness.

* * * * *

UNITED STATES PATENT AND TRADEMARK OFFICE

CERTIFICATE OF CORRECTION

PATENT NO. : 7,403,197 B2
APPLICATION NO. : 10/618074
DATED : July 22, 2008
INVENTOR(S) : Eiden et al.

It is certified that error appears in the above-identified patent and that said Letters Patent is hereby corrected as shown below:

At col. 5, line 59 (claim 1), please insert --be-- prior to “worn”;

At col. 7, line 2 (claim 14), please insert --one-- prior to “half”;

At col. 7, line 22 (claim 20), please change “repetition” to --repetitive--; and At col. 7, line 49 (claim 23), please change “19” to --20--.

Signed and Sealed this

Seventh Day of October, 2008

JON W. DUDAS
*Director of the United States Patent and Trademark Office*